US011235941B2

(12) United States Patent
Silva Coutinho Martins et al.

(10) Patent No.: US 11,235,941 B2
(45) Date of Patent: Feb. 1, 2022

(54) DEVICE AND METHOD FOR AUTOMATICALLY BINDING PRINTED TEXTILE PANELS, OR PRINTED TEXTILE PANELS WITH FLEXIBLE MATERIAL STRIPS

(71) Applicant: MEEVO—TRADING E REPRESENTAÇÕES, LDA, Folgosa (PT)

(72) Inventors: Jorge Filipe Silva Coutinho Martins, Maia (PT); Jorge Manuel Pinhal De Barros Nogueira, Maia (PT)

(73) Assignee: MEEVO—TRADING E REPRESENTAÇÕES, LDA, Folgosa (PT)

( * ) Notice: Subject to any disclaimer, the term of this patent is extended or adjusted under 35 U.S.C. 154(b) by 149 days.

(21) Appl. No.: 16/611,140

(22) PCT Filed: May 7, 2018

(86) PCT No.: PCT/IB2018/053159
§ 371 (c)(1),
(2) Date: Nov. 5, 2019

(87) PCT Pub. No.: WO2018/203314
PCT Pub. Date: Nov. 8, 2018

(65) Prior Publication Data

US 2020/0079611 A1 Mar. 12, 2020

(30) Foreign Application Priority Data

May 5, 2017 (PT) ..... 110060
May 8, 2017 (PT) ..... 110062
Sep. 21, 2017 (PT) ..... 110297

(51) Int. Cl.
*B65H 21/00* (2006.01)
*D05B 33/00* (2006.01)
*D05B 35/10* (2006.01)

(52) U.S. Cl.
CPC ..... *B65H 21/00* (2013.01); *D05B 33/00* (2013.01); *D05B 35/10* (2013.01); *B65H 2301/46326* (2013.01); *B65H 2701/174* (2013.01)

(58) Field of Classification Search
CPC ..... B65H 21/00; B65H 11/00; B65H 2301/46326; B65H 2701/174;
(Continued)

(56) References Cited

U.S. PATENT DOCUMENTS 3,474,747 A * 10/1969 Noiles ..... D05B 21/00 112/308
4,271,767 A 6/1981 Burton et al.
(Continued)

FOREIGN PATENT DOCUMENTS

EP 1953288 8/2008

OTHER PUBLICATIONS

U.S. Pat. No. 372,243 (Joseph Van Ruymbeke), issued on Oct. 25, 1887.
(Continued)

*Primary Examiner* — Ismael Izaguirre
(74) *Attorney, Agent, or Firm* — Leason Ellis LLP

(57) ABSTRACT

The present disclosure relates to a device for automatically binding two or more printed textile panels along a lateral edge of said panels and/or binding a printed textile panel or panels with a flexible material strip along a lateral edge of said panel or panels, said device comprising a sewing head, a puller for pulling the printed textile panel or panels into the sewing head, and a gripper holding system comprising a
(Continued)

plurality of grippers for gripping a portion of a lateral edge of the printed textile panel or panels to maintain alignment as the printed textile panel or panels are pulled into said puller.

19 Claims, 5 Drawing Sheets

(58) Field of Classification Search
CPC ..... D05B 33/00; D05B 35/10; D05B 35/00; D05B 35/06; D05B 27/00; D05B 27/10
See application file for complete search history.

(56) References Cited

U.S. PATENT DOCUMENTS 4,282,820 A * 8/1981 Fenzl ..... D05B 35/00 112/470.14
5,145,158 A * 9/1992 Frye ..... D05B 35/062 270/45
5,215,022 A * 6/1993 Mullis ..... D05B 57/06 112/168
5,582,122 A 12/1996 Funderburk et al.
5,697,309 A * 12/1997 Ogle ..... D05B 11/005 112/2.1
5,775,191 A 7/1998 Burton
5,908,004 A * 6/1999 Porter ..... D05B 35/105 112/470.07
6,055,921 A 5/2000 Olewicz
6,058,863 A 5/2000 Stewart
6,125,777 A * 10/2000 Vollebregt ..... D05B 33/00 112/152
6,155,186 A 12/2000 Schramayr
7,984,681 B1 7/2011 Oxley
8,578,871 B2 * 11/2013 Smith ..... D05B 35/10 112/475.07
2002/0026861 A1 3/2002 Reinders
2004/0129189 A1 * 7/2004 Oxley ..... D05B 11/005 112/2.1
2004/0182210 A1 9/2004 Reinders

OTHER PUBLICATIONS

Written Opinion and International Search Report issued in PCT/IB2018/053159, dated Oct. 18, 2018.

* cited by examiner

DEVICE AND METHOD FOR AUTOMATICALLY BINDING PRINTED TEXTILE PANELS, OR PRINTED TEXTILE PANELS WITH FLEXIBLE MATERIAL STRIPS

CROSS-REFERENCE TO RELATED PATENT APPLICATIONS

This is a U.S. National Phase Application under 35 U.S.C. § 371 of International Patent Application No. PCT/IB2018/053159, filed May 7, 2018, and claims priority to Portuguese Patent Applications PT110060, filed May 5, 2017, PT110062, filed May 8, 2017, and PT110297, filed Sep. 21, 2017, which are incorporated by reference in their entirety. The International Application was published on Nov. 8, 2018, as International Publication No. WO/2018/203314 A1.

TECHNICAL FIELD

The present disclosure relates to a device for automatically binding printed textile panels, for forming a complete image sheet.

BACKGROUND

Outdoor advertisements, for example billboards for hanging in a structure or wall murals for attaching to a wall, are typically manufactured by printing individual panels and using manual labour for binding these panels to form a complete image sheet. These panels need to be trimmed to have proper dimensions, and are then bound together, typically sewn together on a sewing machine. These images are typically large, having standard sizes that can reach many meters high and many meters wide. They are made of textile materials and may comprise many panels that need to be sewn together, typically longitudinally. Also, these textile panels may be fastened with a fastening structure having grooves for receiving flexible material strips which have been previously attached to the textile panels. This flexible material strip may be of silicone or another suitably flexible polymeric material. This strip is a long narrow piece of flexible material fastened to the textile panels which can be inserted into said grooves. The conventional method of sewing those panels requires at least two human operators to perform and typically takes a long time to finalize only one complete image sheet that is determined by not only the panel dimensions but also the ability of the operators.

Document US20040182210 discloses a system for transversely cutting and conveying elongated web, in which a gripper pulls a web off a supply downstream through upstream and downstream clamps. The upstream clamp is closed on the web and a piece is cut off its end. Document US20020026861 discloses a system for transporting and cutting elongated workpiece. Although both cited documents intend to solve the trouble of handling with elongated workpieces, both relate to cutting systems in textile industry trying to compact the device. Document U.S. Pat. No. 5,582,122 discloses an apparatus for feeding a textile piece to a sewing device. However, it is specifically to solve the problem related to rotatably sewing a collarette to a garment and therefore not suitable for elongate workpieces.

These facts are disclosed in order to illustrate the technical problem addressed by the present disclosure.

GENERAL DESCRIPTION

It is disclosed a device for automatically binding two or more printed textile panels along a lateral edge of said panels, said device comprising a sewing head, a puller for pulling the printed textile panels into the sewing head, and a gripper holding system comprising a plurality of grippers for gripping a portion of a lateral edge of the printed textile panels to maintain alignment as the printed textile panels are pulled into said puller;

wherein the grippers are linearly slideable in the printed textile panels feed direction into the sewing head, wherein said grippers are also arranged to be able to be manually closed onto a portion of a lateral edge of said printed textile panels and are arranged to be automatically opened when each said gripper reaches the proximity of said puller.

In an embodiment, said grippers comprise a pair of opposing fingers and actuator means for opening and closing said pair of opposed finger for gripping the portion of a lateral edge of said printed textile panels.

In an embodiment, the grippers are freely and linearly slideable in the printed textile panels feed direction into the sewing head.

An embodiment comprises a motor for moving the grippers linearly slideably in the printed textile panels feed direction into the sewing head and a controller configured to control said motor to advance the grippers in response to the movement of the printed textile panels, to assist the movement of the printed textile panels such that the printed textile panels are pulled, but not pushed, into the sewing head.

In an embodiment, the puller comprises an upper puller and a lower puller arranged to apply a resilient pressure to printed textile panels between the upper and lower pullers, to hold and pull said panels.

In an embodiment, the resilient pressure is adjustable.

In an embodiment, each said upper and lower puller comprises a belt and rollers that are mutually engaged to move synchronously over and under, respectively, the printed textile panels.

In an embodiment, the upper puller is arranged to swing over the textile panels by rotating on an upper puller pivot. In an embodiment, the upper puller is arranged to move up and down over the textile panels by articulating on an articulated support arm.

In an embodiment, the grippers are arranged to move back to an initial position for manually closure onto a portion of a lateral edge of said printed textile panels, when all said grippers have reached the proximity of said puller.

An embodiment comprises one or more conveyor belts for transporting said printed textile panels along the feed direction.

An embodiment comprises two belts synchronized between themselves and with the puller.

In an embodiment, the lower puller is solidly fixed to the structure and, if existing, is substantially planar with the conveyor belt or belts.

In an embodiment, the lower puller is solidly fixed to the support structure of the device.

An embodiment comprises 2 to 10 grippers, in particular 2 to 6 grippers, further in particular 4 grippers.

In an embodiment, the grippers are arranged to have a rest position, for manually closure onto a portion of a lateral edge of said printed textile panels, spaced 20 cm to 2 m, in particular 1 m to 2 m, or in particular 40 cm to 50 cm.

In an embodiment, the grippers are configured to be engaged by pneumatic pressure.

In an embodiment, a part of the grippers is deactivatable.

In an embodiment, said sewing head is an overlock machine.

In an embodiment, said overlock machine is for trimming and sewing the edges of the printed textile panels.

It is also disclosed a device for automatically binding two or more printed textile panels along a lateral edge of said panels and for binding a printed textile panel or panels with a flexible material strip along a lateral edge of said panel, said device comprising a sewing head, a puller for pulling the printed textile panel or panels into the sewing head, and a gripper holding system comprising a plurality of grippers for gripping a portion of a lateral edge of the printed textile panel or panels to maintain alignment as the printed textile panel or panels are pulled into said puller;

wherein the grippers are linearly slideable in the printed textile panel feed direction into the sewing head, wherein said grippers are also arranged to be able to be manually closed onto a portion of a lateral edge of said printed textile panel or panels and each said gripper is arranged to be automatically opened when each said gripper reaches the proximity of said puller.

It is also disclosed a device for automatically binding a printed textile panel or panels with a flexible material strip along a lateral edge of said panel, said device comprising a sewing head, a puller for pulling the printed textile panel or panels into the sewing head, and a gripper holding system comprising a plurality of grippers for gripping a portion of a lateral edge of the printed textile panel or panels to maintain alignment as the printed textile panel or panels are pulled into said puller;

wherein the grippers are linearly slideable in the printed textile panel feed direction into the sewing head, wherein said grippers are also arranged to be able to be manually closed onto a portion of a lateral edge of said printed textile panel or panels and each said gripper is arranged to be automatically opened when each said gripper reaches the proximity of said puller.

An embodiment comprises a flexible material strip feeder for feeding the flexible material strip between said puller and said sewing head.

In an embodiment, said flexible material strip feeder is arranged to feed the flexible material strip under the textile panel to be joined together by the sewing head.

In an embodiment, said flexible material strip feeder is arranged to feed the flexible material strip under the textile panels to be joined together by the sewing head.

In an embodiment, said flexible material strip feeder comprises a feeding plate, the feeder being arranged such that the flexible material strip is fed under said sliding plate and such that the textile panel or panels are pulled over said sliding plate.

In an embodiment, said flexible material strip feeder comprises a feeding mechanism under said plate for feeding the flexible material strip and a pulley for conducting the flexible material strip into the feeding mechanism, arranged such that the flexible material strip is fed below the textile panel or panels to be joined together by the sewing head.

The feeding of the flexible material strip under the textile panel or panels to be immediate and subsequently joined together by the sewing head has advantages: the feeding path is facilitated, the visibility of the textile or panels above the strip allows visual inspection and easy manual alignment, the sewing head grabs the panel(s) and strip together shortly after thus without having a chance for misaligning.

In an embodiment, said sewing head is an overlock machine for sewing the edge(s) of the printed textile panel(s) with the flexible material strip.

It is also disclosed a method for operating a device for automatically binding two or more overlaid printed textile panels along a lateral edge of said panels, said method comprising:

placing the printed textile panels along a feed alignment zone; closing grippers of a gripper holding system onto the lateral edges of the overlaid printed textile panels to ensure the alignment of the printed textile panels;

feeding the overlaid printed textile panels towards a puller by one or two synchronized conveyor belts moving said grippers;

opening the first gripper of the gripper holding system once the overlaid printed textile panels reach the puller;

pulling the overlaid printed textile panels by the puller throughout an entire sewing cycle while:

opening the subsequent gripper or grippers of the gripper holding system once each said subsequent gripper or grippers reaches the proximity of said puller;

moving of the grippers forward along with the overlaid printed textile panels;

trimming and sewing the lateral edge of the overlaid printed textile panels by a sewing head;

after the sewing cycle, returning the grippers of the gripper holding system to their initial position at the feed alignment zone.

BRIEF DESCRIPTION OF THE DRAWINGS

The following figures provide preferred embodiments for illustrating the description and should not be seen as limiting the scope of invention.

DETAILED DESCRIPTION

Figure 1:
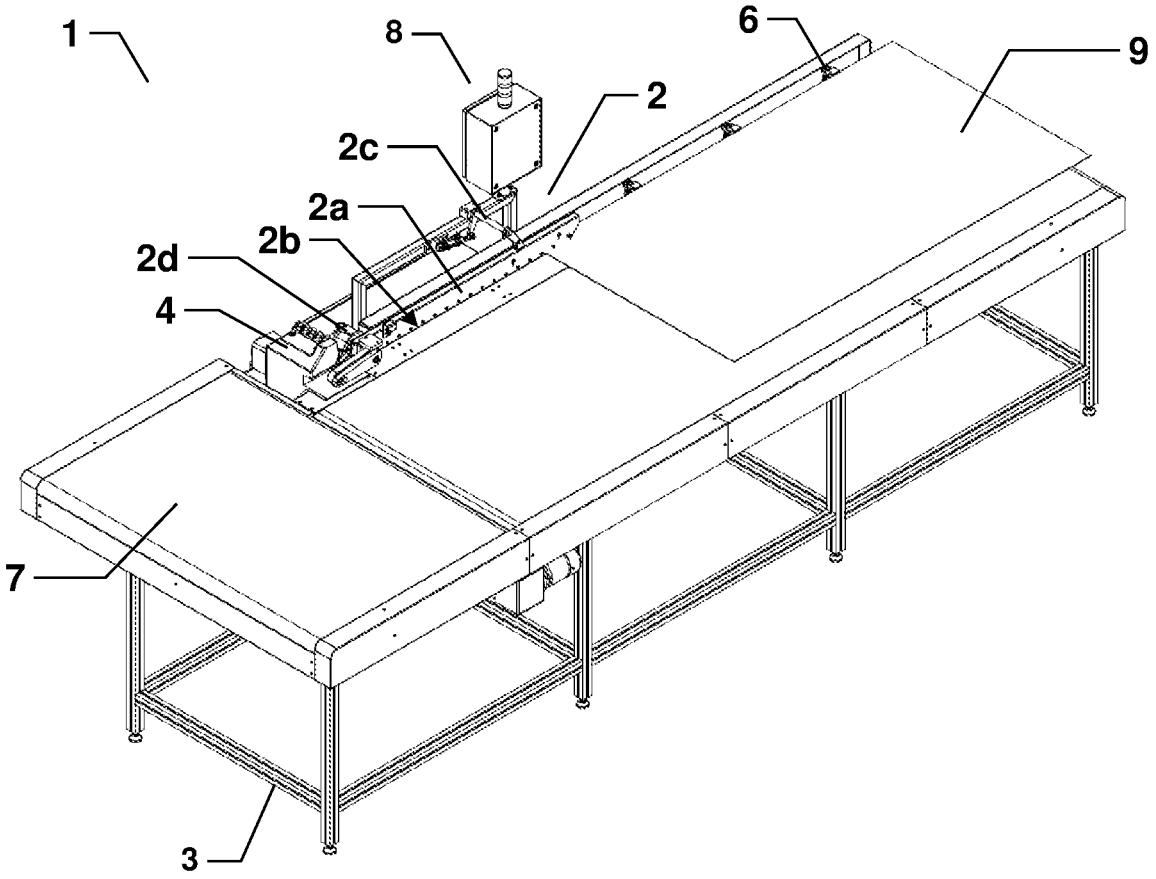
FIG. 1: Perspective view of a schematic representation of an embodiment of the disclosed device and its components seen from the printed textile panel transport side
Figure 2:
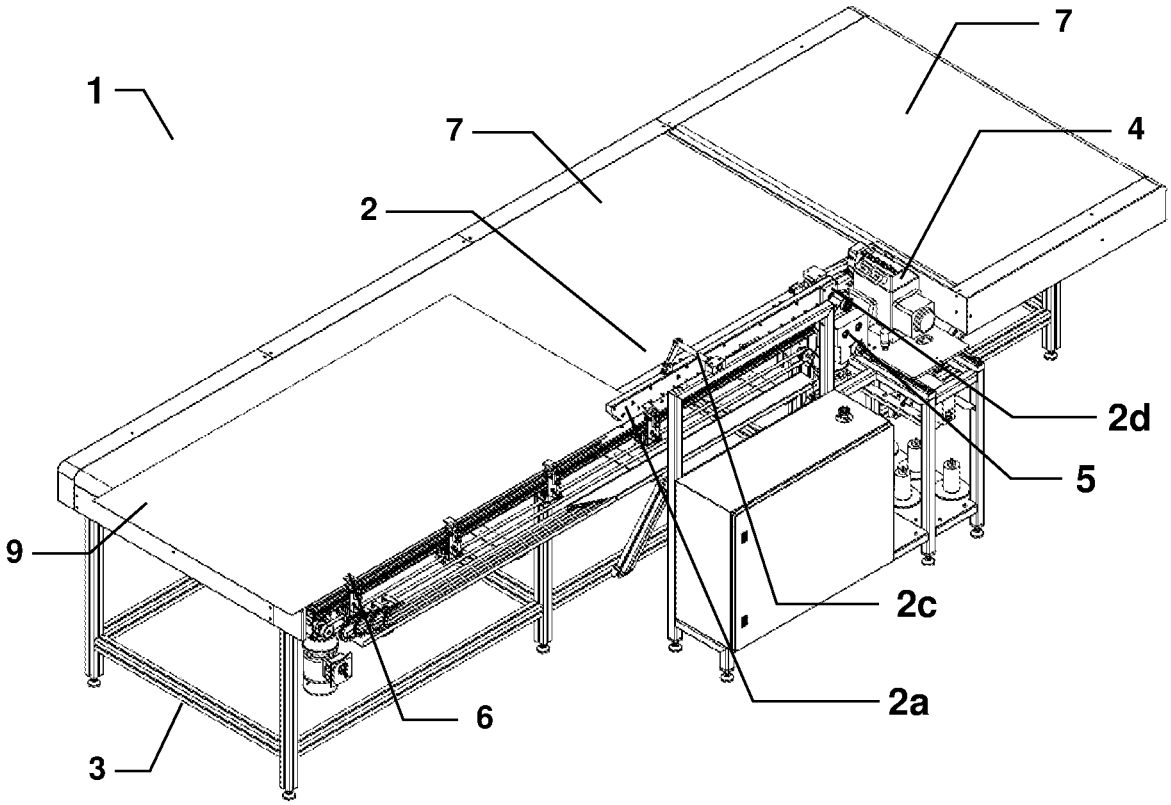
FIG. 2: Perspective view of a schematic representation of an embodiment of the disclosed device seen from the operator side.
Figure 3:
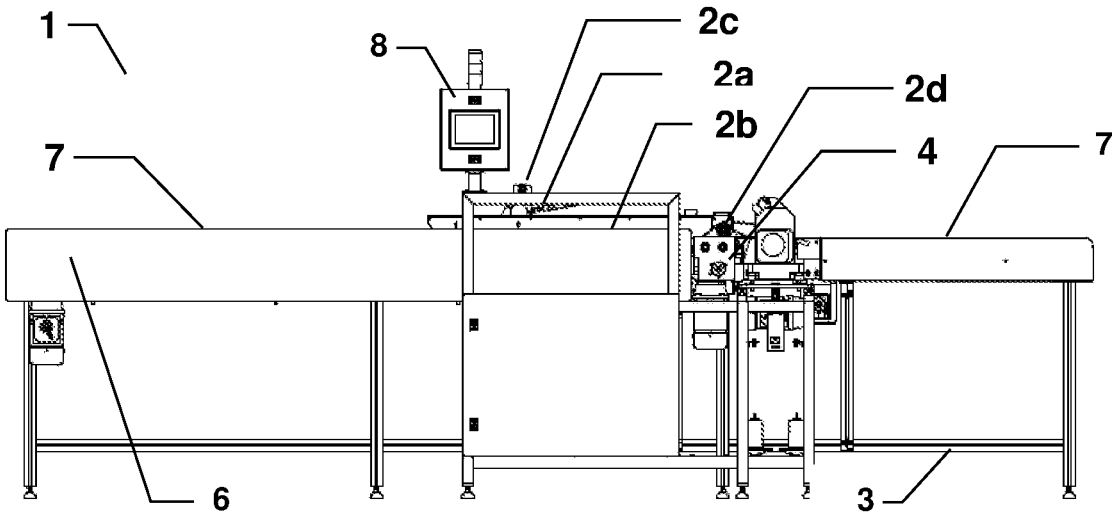
FIG. 3: Front view of a schematic representation of an embodiment of the disclosed device seen from the operator side.
Figure 4:
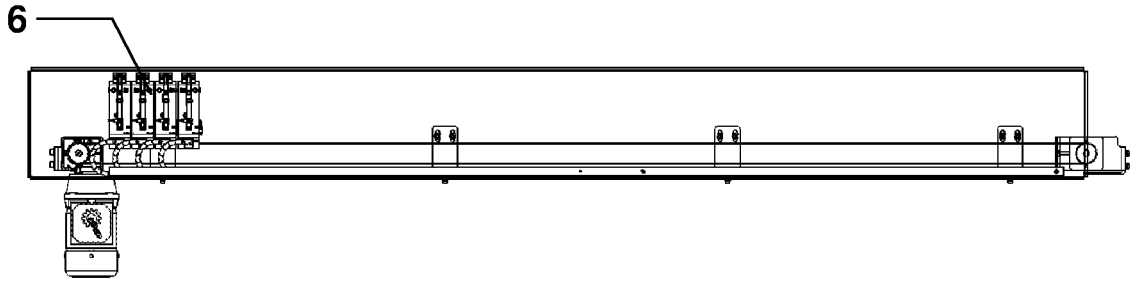
FIG. 4: View of an embodiment of the gripping system comprising four grippers seen from the front side at the beginning of the sewing operation cycle.
Figure 5:
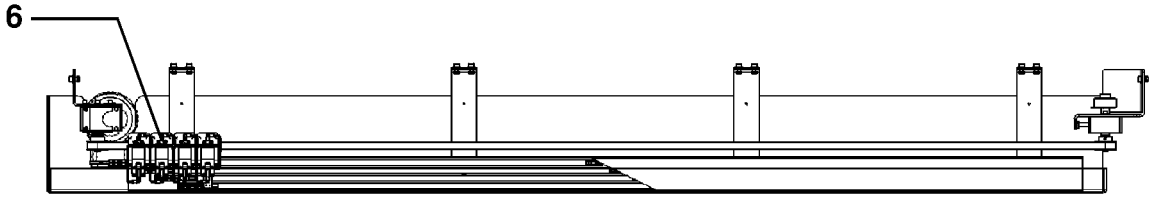
FIG. 5: View of an embodiment of the gripping system comprising four grippers seen from the top at the beginning of the sewing operation cycle.
Figure 6:
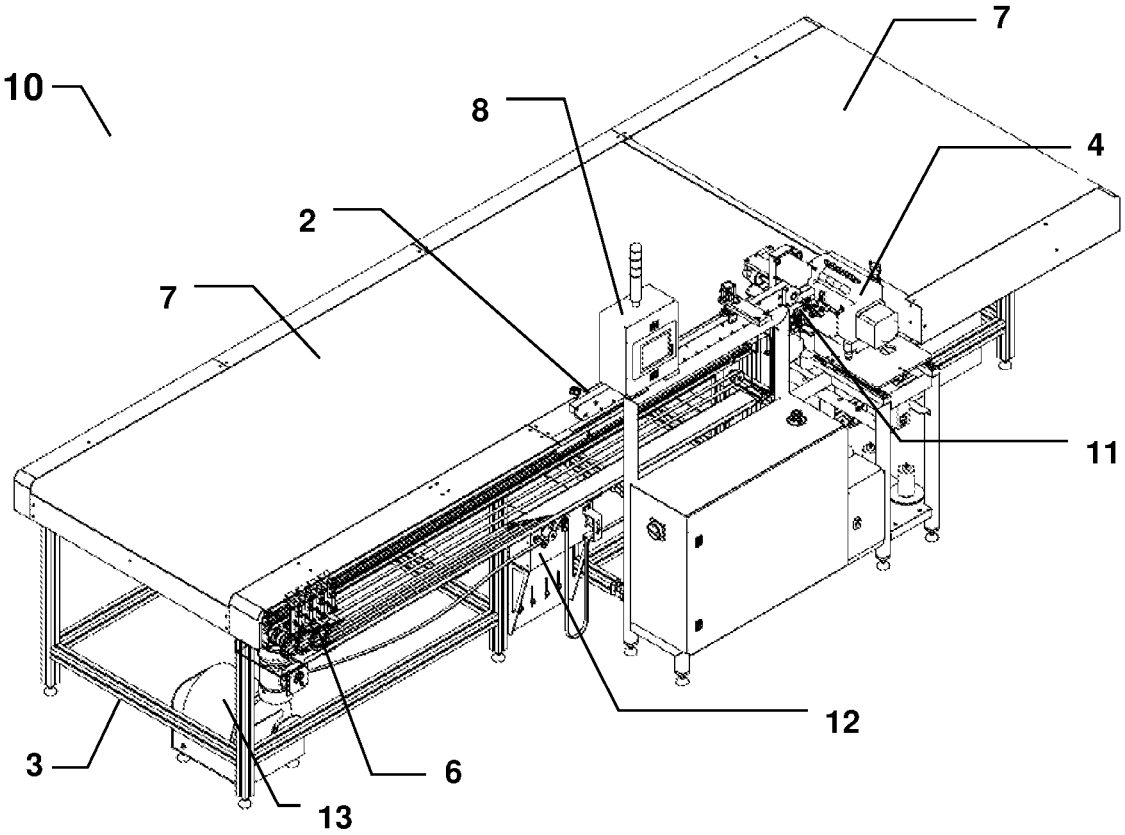
FIG. 6: Perspective view of a schematic representation of an embodiment of the disclosed device suitable for binding printed a textile panel or panels with a flexible material strip along a lateral edge of said panel or panels, seen from the operator side.
Figure 7:
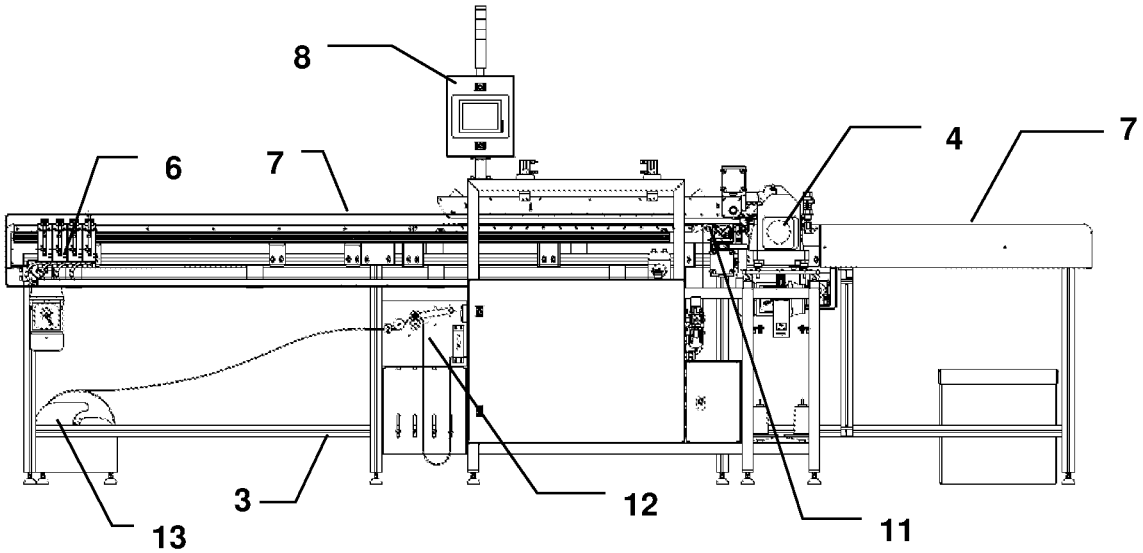
FIG. 7: Front view of a schematic representation of an embodiment of the disclosed device suitable for binding printed a textile panel or panels with a flexible material strip along a lateral edge of said panel or panels, seen from the operator side.
Figure 8:
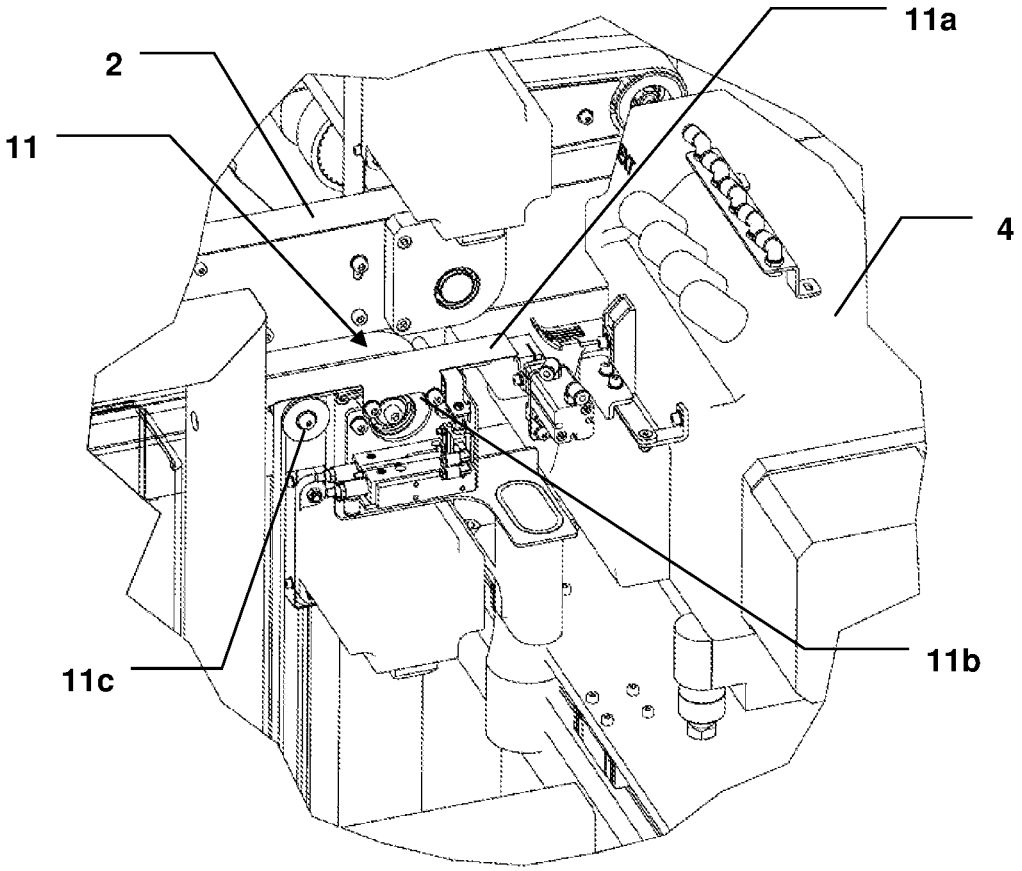
FIG. 8: Detailed view of a schematic representation of an embodiment of the flexible material strip feeder and its placement relative to the sewing head and puller.
Figure 9:
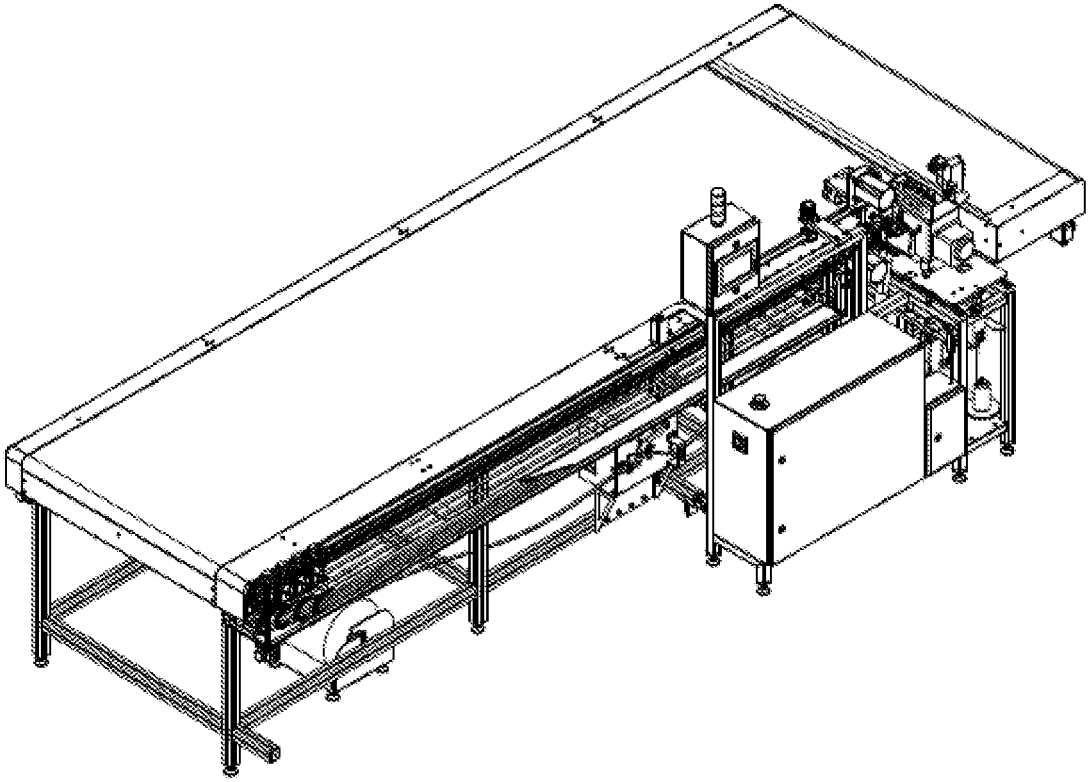
FIG. 9: Perspective view of a schematic representation of an embodiment of the disclosed device seen from the operator side.
Figure 10:
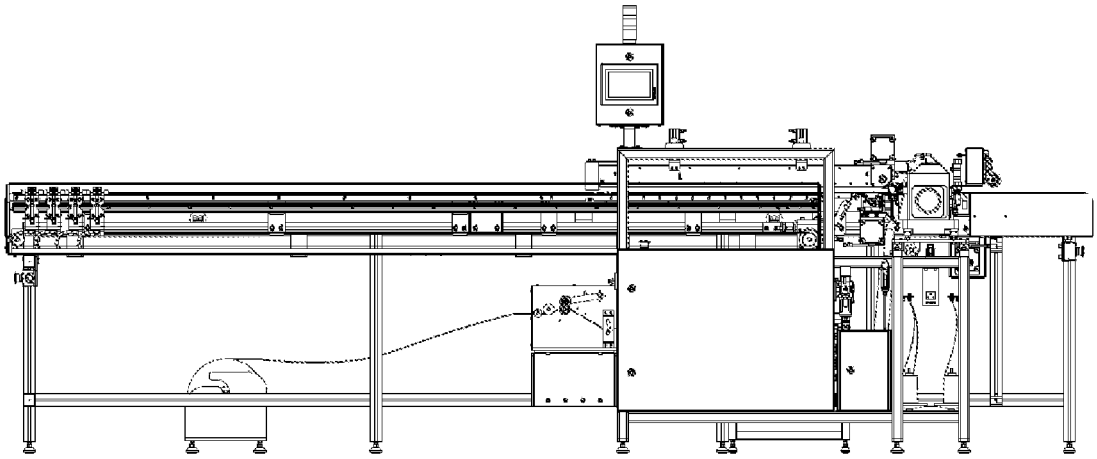
FIG. 10: Front view of a schematic representation of an embodiment of the disclosed device seen from the operator side.

The present disclosure relates to an automatic device for binding printed textile panels (1), an embodiment of which comprises a puller (2), a sewing head (4), an optional puller gearbox (5), a gripper holding system (6), a conveyor belt (7), and a controller (8).

An embodiment of the automatic device (1) for longitudinally binding two or more overlaid printed textile panels (9) comprises a support structure (3) which supports other elements of the device, a sewing head (4) for binding the printed textile panels; a conveyor belt or belts (7) for feeding the printed textile panels towards the sewing head (4), a puller (2) for pulling the printed textile panels into the sewing head, a gripper holding system (6) comprising a plurality of grippers, for example four grippers.

The puller (2) may comprise upper puller (2*a*), a lower puller (2*b*), an articulated support arm (2*c*), upper puller pivot (2*d*), such that the puller is able to tilt and lift up to accommodate different printed textile panel thicknesses or irregularities, while keeping in contact as much as possible with the printed textile panels such that the puller is effective.

The conveyor belt or belts (7) may comprise and are engaged with a drive roller, which is included in a tread base, held by the support structure of the device (3).

The puller (2) may comprise a puller gearbox (5).

The device may comprise a controller (8) having a data processor to control the sewing machine.

The figures also represent the overlaid textile printed panels (9) to be bound together, typically two. Other elements, typically textile elements, may also be bound together with the textile printed panels.

The gripper holding system comprises grippers, for example four, that hold the textile printed panels (9) together while they are moving forward on the conveyor belt until the printed panels reach the puller. The grippers are used to hold the edges of both textile printed panels that are intended to be bound together and guide them into the puller keeping them perfectly aligned.

For too soft, elastic or flexible textile panels, these grippers hold them in such a way that the pressure applied on the fabrics is strong enough to keep their predefined alignment throughout the sewing cycle but softly enough to avoid any lengthening or distorting of a soft textile panel.

For very rigid textile sheets, the grippers do not need to apply any traction, they slide freely longitudinally in the feed direction, for example by sliding along a track. Therefore, the traction of the textile printed panels is fully ensured by the puller and the conveyor belts, as the grippers maintain only a joining force between the textile panels to be bound together. The grippers are pulled longitudinally along the feed direction by the printed textile panels as these are transported by the puller and the belt conveyor.

However, for lighter materials the grippers may have some traction assistance. This is useful for very light or soft materials which may not be able to pull the grippers along the feed direction. In this case, the traction assistance should be enough to avoid damage or distorting of the textile material, but not strong enough that the printed textile panels are pushed towards the sewing head. Preferably, the traction applied by the grippers on the textile sheets might be adapted by the operator.

An embodiment of the sewing cycle comprises an alignment and gripper engagement phase (manual), a feed and sewing phase, and a gripper return phase.

Normally, the operator will feed the printed textile panels manually until they reach the puller. Once the printed textile panels reach the puller, the puller is engaged to hold the printed textile panels. The operator ensures that the printed textile panels are correctly aligned such that the bound complete image sheet will result aligned. The operator also proceeds to apply the grippers along a side of the printed textile panels in a feed alignment zone, by closing the grippers onto the printed textile panels, such that they grip the printed textile panels to keep them aligned.

The printed textile panels will be held by the grippers and pulled only by the puller (and also transported by the belt conveyor) and the grippers only work to keep the predefined alignment of the printed textile panels. This also helps to stabilize the textile sheets and reduce wrinkles or distortions in the final product.

Alternatively, when there is a motor for moving the grippers, the operator will not need to feed the printed textile panels manually until they reach the puller. The operator only needs to feed the printed textile panel or panels to the grippers in a feed alignment zone and, subsequently, start the system. The operator should ensure that the printed textile panel or panels are correctly aligned before starting the system. Once the printed textile panel or panels reach the puller carried by the grippers and respective motor, the puller is engaged to hold the printed textile panels.

As the printed textile panels are pulled by the puller, the first gripper reaches the beginning of the puller and opens such that the printed textile panels are then kept aligned and pulled onto the sewing head by the puller. This first gripper stays along the puller until the end of the sewing cycle.

The other grippers (for example, three grippers) continue to move forward along with the textile printed panels and, as they sequentially reach the puller, they each of the grippers opens such that the printed textile panels are then kept aligned and pulled onto the sewing head by the puller. The remaining grippers stop just next to the first gripper, one after another.

Before a new cycle is initiated, the grippers automatically move back to their initial position at the feed alignment zone.

The controller (8) detects the position of the grippers using sensors placed along the gripper travel distance from the feed alignment zone to the puller zone.

A sensor may also be used for detecting when a gripper reaches the puller zone, in order to open said gripper. Alternatively, this opening may be triggered mechanically.

A part of the grippers may be deactivated and not used, for example when the textile material is more rigid and does not need that many grippers.

A gripper may comprise a column and two mechanically operated fingers at the top of the column. These fingers are engageable to close and grip a material between them.

Preferably, the grippers are engaged by pneumatic pressure.

A gripper may comprise a stop on its lower finger to receive a lateral edge of the printed textile panels to be bound together. This facilitates the alignment by the human operator.

The puller (2) may comprise an upper puller (2*a*), a lower puller (2*b*), an articulated support arm (2*c*) and an upper puller pivot (2*d*), that pulls and holds the fabric to the sewing head. To be able to pull both layers of the fabric and other accessories (if necessary) that may be included in a sandwich structure, such as straps or eyelets, the puller is preferably not solidly fixed to the structure and one or more degrees of freedom are allowed.

The upper puller (2*a*) is capable to swing over the textile panels by rotating on an upper puller pivot (2*d*) allowing the system to pull the all structure together without losing efficiency and alignment.

The upper puller (2*a*) is preferably capable to move up and down over the textile panels by articulating on an articulated support arm (2*c*).

The lower puller (2*b*) is preferably solidly fixed to the structure and is substantially planar with the conveyor belt or belts (7).

Preferably, each of the upper (2*a*) and lower puller (2*b*) comprises a belt and rollers that are mutually engaged to move synchronously over and under, respectively, the printed textile panels and, therefore, applying an adjustable resilient pressure to the printed textile panels to hold them, and pull them, between the upper and lower pullers, without damaging the fabric.

At the end of the puller, the printed textile panels are sewed together by the sewing head. The textile sheets may be also trimmed to have proper dimensions as they are sewn together by the sewing head (4). The waste material resulted from trimming is preferably stored in a container placed under the sewing head (4), which may be operated by vacuum.

The sewing head (4) may be an overlock sewing machine that trims the edges of the textile sheets as they are fed through for sewing. Other sewing machines may be used alternatively, such as a simple sewing machine without cutters, ultrasound sewing machine, or heat fusion sewing machine.

The textile sheets are preferably driven and supported by conveyor belt, preferably comprising two belts (7) synchronized between themselves and with the puller (2), throughout the sewing cycle, allowing a larger size of printed textile panels (9) to be held by the grippers without wrinkles or distortions.

Preferably, one of the two conveyor belts (7) is located before the sewing head (4) and the other of the two conveyor belts (7) is located after the sewing head (4), in respect of the printed textile panel feed direction.

The puller is preferably 0.5 to 2.0 m long, in particular 1.0 to 1.5 m long, further in particular 1.4 m long. A longer puller provides more space for 'storing' the grippers, allows more room to stop the device in case of a problem, provides more traction and a longer sewing cycle. A shorter puller will be more compact and less expensive.

The grippers are preferably 2 to 10 grippers, in particular 2 to 6, further in particular 4. More grippers allow a larger feed alignment zone with a larger length of printed textile panels to be aligned in each sewing cycle, but take more time and imply more effort for the human operator. Fewer grippers are less expensive and take less time to apply, but a minimum of grippers is required such that the space of printed textile panels between grippers is not too long, causing wrinkles and misalignments. The space between grippers in the feed alignment zone is preferably 20 cm to 2 m, in particular 1 to 2 m, or in particular 40 to 50 cm.

The sewing machine is preferably fed the sewing line or lines through tubes, in order to avoid entanglements. The sewing line or lines can be inserted into said tubes by using compressed air.

It is disclosed a device for automatically binding two or more printed textile panels (1) along a lateral edge of said panels, said device comprising a sewing head (4), a puller (2) for pulling the printed textile panels (9) into the sewing head (4), and a gripper holding system (6) comprising a plurality of grippers for gripping a portion of a lateral edge of the printed textile panels (9) to maintain alignment as the printed textile panels are pulled into said puller;

wherein the grippers (6) are linearly slidable in the printed textile panels feed direction into the sewing head (4), wherein said grippers (6) are also arranged to be able to be manually closed onto a portion of a lateral edge of said printed textile panels (9) and are arranged to be automatically opened when each said gripper (6) reaches the proximity of said puller.

The plurality of grippers are for gripping together a portion of a lateral edge of each of the printed textile panels (9) to maintain alignment as the printed textile panels are pulled in.

It is disclosed a device for automatically binding two or more printed textile panels (1) along a lateral edge of said panels, said device comprising a sewing head (4), and a gripper holding system (6) comprising a plurality of grippers for gripping together a portion of a lateral edge of each of the printed textile panels (9) to maintain alignment as the printed textile panels are pulled into said sewing head (4);

wherein the grippers (6) are linearly slidable in the printed textile panels feed direction into the sewing head (4), wherein said grippers (6) are also arranged to be able to be manually closed onto a portion of a lateral edge of said printed textile panels (9) and are arranged to be automatically opened when each said gripper (6) reaches the proximity of said sewing head (4).

In an embodiment, said grippers (6) comprise a pair of opposing fingers and actuator means for opening and closing said pair of opposed finger for gripping the portion of a lateral edge of said printed textile panels (9).

In an embodiment, the grippers (6) are freely and linearly slidable in the printed textile panels (9) feed direction into the sewing head (4).

An embodiment comprises a motor for moving the grippers linearly slideably in the printed textile panels (9) feed direction into the sewing head (4) and a controller (8) configured to control said motor to advance the grippers (6) in response to the movement of the printed textile panels (9), to assist the movement of the printed textile panels (9) such that the printed textile panels (9) are pulled, but not pushed, into the sewing head (4).

In an embodiment, the puller (2) comprises comprise an upper puller (2*a*) and a lower puller (2*b*) arranged to apply a resilient pressure to printed textile panels (9) between the upper (2*a*) and lower (2*b*) pullers, to hold and pull said panels (9).

In an embodiment, the resilient pressure is adjustable.

In an embodiment, each said upper (2*a*) and lower (2*b*) puller comprises a belt and rollers that are mutually engaged to move synchronously over and under, respectively, the printed textile panels (9).

In an embodiment, the upper puller (2*a*) is arranged to swing over the textile panels (9) by rotating on an upper puller pivot (2*d*).

In an embodiment, the upper puller (2*a*) is arranged to move up and down over the textile panels by articulating on an articulated support arm (2*c*).

In an embodiment, the grippers (6) are arranged to move back to an initial position for manually closure onto a portion of a lateral edge of said printed textile panels (9), when all said grippers (6) have reached the proximity of said puller.

An embodiment comprises one or more conveyor belts (7) for transporting said printed textile panels (9) along the feed direction.

An embodiment comprises two belts (7) synchronized between themselves and with the puller (2).

In an embodiment, the lower puller (2*b*) is solidly fixed to the structure and, if existing, is substantially planar with the conveyor belt or belts (7).

An embodiment comprises a support structure (3) wherein the lower puller (2*b*) is solidly fixed to.

An embodiment comprises 2 to 10 grippers, in particular 2 to 6 grippers, further in particular 4 grippers.

In an embodiment, the grippers (6) are arranged to have a rest position, for manually closure onto a portion of a lateral edge of said printed textile panels (9), spaced 20 cm to 2 m, in particular 1 m to 2 m, or in particular 40 cm to 50 cm.

In an embodiment, the grippers (6) are configured to be engaged by pneumatic pressure.

In an embodiment, a part of the grippers (6) is de activatable.

In an embodiment, said sewing head (4) is an overlock machine.

In an embodiment, said overlock machine is for trimming and sewing the edges of the printed textile panels (9).

The present disclosure also relates to an automatic device (0) for binding printed textile panels (9) and/or binding a printed panel to a flexible material strip, an embodiment of which comprises a puller (2), a sewing head (4), a gripper holding system (6), a conveyor belt (7), a flexible material strip feeder (11), and a controller (8).

An embodiment of the automatic device (10) for longitudinally binding two or more overlaid printed textile panels (9) and/or binding a printed panel to a flexible material strip comprises a support structure (3) which supports other elements of the device, a sewing head (4) for binding the printed textile panels; a conveyor belt or belts (7) for feeding the printed textile panels towards the sewing head (4), a puller (2) for pulling the printed textile panels into the sewing head, a gripper holding system (6) comprising a plurality of grippers, for example four grippers, a flexible material strip feeder (11), a flexible material strip storage (13), and a flexible material strip tensioning pre-feeder (12).

An embodiment of the flexible material strip feeder (11) comprises a feeding plate (11*a*) under which the flexible material strip is fed and over which the textile panel or panels are moved, a feeding mechanism (11*b*) under said plate for feeding the flexible material strip, and a pulley (11*c*) for conducting the flexible material strip into the feeding mechanism (11*b*), such that the flexible material strip is fed below the textile panel or panels to be joined together by the sewing head (4).

The above embodiments are combinable. The disclosure should not be seen in any way restricted to the embodiments described and a person with ordinary skill in the art will foresee many possibilities to modifications thereof. The following claims further set out particular embodiments of the disclosure.

The invention claimed is:

1. A device for automatically binding two or more printed textile panels along a lateral edge of said panels and/or binding a printed textile panel or panels with a flexible material strip along a lateral edge of said panel or panels, said device comprising a sewing head, a puller for pulling the printed textile panel or panels into the sewing head, and a gripper holding system comprising a plurality of grippers for gripping a portion of a lateral edge of the printed textile panel or panels to maintain alignment as the printed textile panel or panels are pulled into said puller;

wherein the grippers are linearly slideable in the printed textile panel feed direction into the sewing head, wherein said grippers are further arranged to be able to be manually closed onto a portion of a lateral edge of said printed textile panel or panels and each said gripper is arranged to be automatically opened when each said gripper reaches the proximity of said puller, and wherein said grippers comprise a pair of opposing fingers and actuator means for opening and closing said pair of opposing fingers for gripping the portion of a lateral edge of said printed textile panels.

2. The device according to claim 1, wherein the grippers are freely and linearly slideable in the printed textile panels feed direction into the sewing head.

3. The device according to claim 1, comprising a motor for moving the grippers linearly slideably in the printed textile panels feed direction into the sewing head and a controller configured to control said motor to advance the grippers in response or in synchronism to the movement of the printed textile panels, to assist the movement of the printed textile panels such that the printed textile panels are pulled, but not pushed, into the sewing head.

4. The device according to claim 1, wherein the puller comprises an upper puller and a lower puller arranged to apply a resilient pressure to the printed textile panels between the upper and lower pullers, to hold and pull said panels.

5. The device according to claim 4, wherein each said upper and lower puller comprises a belt and rollers that are mutually engaged to move synchronously over and under, respectively, the printed textile panels.

6. The device according to claim 4, wherein the upper puller is arranged to move up and down over the textile panels by articulating on an articulated support arm.

7. The device according to claim 1, wherein the grippers are arranged to automatically move back to an initial position for manually closure onto a portion of a lateral edge of said printed textile panels, when all said grippers have reached the proximity of said puller.

8. The device according to claim 1, comprising one or more conveyor belts for transporting said printed textile panels along the feed direction.

9. The device according to claim 8, comprising two conveyor belts synchronized between themselves and with the puller.

10. The device according to claim 4, comprising one or more conveyor belts for transporting said printed textile panels along the feed direction, wherein the lower puller is substantially planar with the conveyor belt or belts.

11. The device according to claim 1, comprising 2 to 10 grippers.

12. The device according to claim 1, wherein the grippers are arranged to have a rest position, for manually closure onto a portion of a lateral edge of said printed textile panels, spaced 20 cm to 2 m.

13. The device according to claim 1, wherein said sewing head is an overlock sewing machine configured for simultaneously sewing and trimming the edges of the printed textile panels.

14. The device according to claim 1, wherein said sewing head is an ultrasound sewing machine or a heat fusion sewing machine.

15. The device according to claim 1, comprising a flexible material strip feeder for feeding the flexible material strip between said puller and said sewing head.

16. The device according to claim 15, wherein said flexible material strip feeder is arranged to feed the flexible material strip under the textile panel or panels to be joined together by the sewing head.

17. The device according to claim 16, wherein said flexible material strip feeder comprises a feeding plate, the feeder being arranged such that the flexible material strip is fed under said sliding plate and such that the textile panel or panels are pulled over said sliding plate.

18. The device according to claim 16, wherein said flexible material strip feeder comprises a feeding mechanism under said plate for feeding the flexible material strip and a pulley for conducting the flexible material strip into the feeding mechanism, arranged such that the flexible material strip is fed below the textile panel or panels to be joined together by the sewing head.

19. A method for operating a device for automatically binding two or more overlaid printed textile panels along a lateral edge of said panels, said method comprising:

placing the printed textile panels along a feed alignment zone;

closing grippers of a gripper holding system onto the lateral edges of the overlaid printed textile panels to ensure the alignment of the printed textile panels;

feeding the overlaid printed textile panels towards a puller by one or two synchronized conveyor belts moving said grippers;

opening the first gripper of the gripper holding system once the overlaid printed textile panels reach the puller;

pulling the overlaid printed textile panels by the puller throughout an entire sewing cycle while:

opening the subsequent gripper or grippers of the gripper holding system once each said subsequent gripper or grippers reaches the proximity of said puller;

moving of the grippers forward along with the overlaid printed textile panels;

trimming and sewing the lateral edge of the overlaid printed textile panels by a sewing head;

after the sewing cycle, returning the grippers of the gripper holding system to their initial position at the feed alignment zone.

* * * * *